US005975934A

United States Patent [19]

Ichimura

[11] Patent Number: 5,975,934

[45] **Date of Patent: *Nov. 2, 1999**

[54] TWO-PIECE ELECTRICAL CONNECTOR OF ZIF TYPE USING FLEXIBLE PRINTED CIRCUIT BOARDS AS CONTACT ELEMENTS

[75] Inventor: Yoshiaki Ichimura, Akiruno, Japan

[73] Assignee: Japan Aviation Electronics Industry, Ltd., Tokyo, Japan

[ * ] Notice: This patent is subject to a terminal disclaimer.

[21] Appl. No.: 08/991,102

[22] Filed: Dec. 12, 1997

[51] Int. Cl.[6] ..... H01R 13/15

[52] U.S. Cl. ..... 439/260; 439/67

[58] Field of Search ..... 439/67, 77, 259, 439/260, 493–495, 629–638

[56] References Cited

U.S. PATENT DOCUMENTS 5,041,003 8/1991 Smith et al. ..... 439/259
5,227,959 7/1993 Rubinstein et al. ..... 439/259
5,622,505 4/1997 Hashiguchi et al. ..... 439/67
5,735,709 4/1998 Hashiguchi et al. ..... 439/495

*Primary Examiner*—Khiem Nguyen
*Attorney, Agent, or Firm*—J. Warren Whitesel; Laff, Whitesel & Saret

[57] ABSTRACT

In a two-piece connector for use in electrical connector between two PCBs, a connector member has a pair of flexible printed circuits as two contact rows of a plurality of contact elements with opposite first and second ends being connected to one of PCBs and being brought into contact with contacts of a mating connector member, respectively. An elastic plate is fixed to the second end of each flexible printed circuit. The mating connector member has a projection and a pair of grooves into which the contacts are disposed to be exposed. Each groove loosely receives the second end of each flexible printed circuit when both connector member is mated, and the projection engages and urges each of the elastic plates to bring the second end of each flexible printed circuit into press contact with the contacts.

9 Claims, 4 Drawing Sheets

TWO-PIECE ELECTRICAL CONNECTOR OF ZIF TYPE USING FLEXIBLE PRINTED CIRCUIT BOARDS AS CONTACT ELEMENTS

BACKGROUND OF THE INVENTION

This invention relates to an electrical connector for use in electrical connection and electrical disconnection between first and second electrical devices, the connector comprising first and second connector members to be mechanically mounted on and electrically connected to the first and second electrical devices, respectively, and, in particular to such a two-piece electrical connector using flexible printed circuit boards (FPCs) as contact elements.

A one-piece electrical connector is well known in the prior art for connection between two printed circuit boards (PCBs). The electrical connector is mounted on one PCB and another PCB is directly inserted or fitted to the electrical connector for establishing the electrical connection. In the one-piece electrical connector, it is also known in the prior art to use FPCs as contact elements The use of FPC as contact elements is superior in high density of contacts to the use of conventional discrete metal contacts. However, the connector using FPC needs to a zero-insertion force (ZIF) arrangement for preventing any insertion force from being applied to the FPC because the FPC is easily bent and damaged by the insertion force applied thereto.

JP-A-3 30273 discloses a one-piece connector using FPC which has a ZIF structure where a connecting action is performed after an insertion operation of PCB into the connector. Therefore, the insertion force is not applied to the FPC.

However, the conventional connector is complicated in the structure and large in the size despite of using the FPC. In addition, the conventional connector is complicated in the operation because the connector needs not only insertion operation but also connecting operation.

Another connector is disclosed in JP-A-4 501338 having another ZIP structure using shape memory alloy and a beater for heating the alloy. In the known connector, the connecting action is performed due to shape recovery of the shape memory alloy caused by heating the alloy after insertion operation of the PCB into the connector. Therefore, the insertion force is not applied to the FPC.

However, the known connector is also complicated in the structure and large in the size despite of using the FPC. In addition, it is required to exactly control an environment temperature to avoid erroneous operation of the alloy. Further, the known connector unit is expensive in the cost because the shape memory alloy is relatively expensive.

In addition, those known ZIP structures do not teach application for a two-piece connector.

SUMMARY OF THE INVENTION

It is therefore an object of this invention to provide a two-piece electrical connector using FPC as contact elements and having a simple ZIP structure.

This invention is applicable to an electrical connector for use in electrical connection and electrical disconnection between first and second electrical devices, comprising first and second connector members to be mechanically mounted on and electrically connected to the first and second electrical devices, respectively, the first and second connector members being fitted in a first direction to be coupled with each other for the electrical connection and decoupled from each other for the electrical disconnection. According to this invention, the first connector member comprises: a first insulator to be mounted to the first electrical device and having a first outer surface directed in the first direction; first flexible printed circuit means having opposite first and second circuit ends and having a printed conductor pattern of a plurality of conductor lines extending in parallel with one another from the first circuit end to the second circuit end and serving as first contact elements, the first flexible printed circuit means being held in the first insulator with the first circuit end being led out from the first insulator to be connected to the first electrical device while the second circuit end being led out from the first outer surface; and elastic plate means having opposite first and second plate ends, the second plate end being fixed to the second circuit end. The second connector member comprises: a second insulator to be mounted on the second electrical device and having groove means formed therein to open in the first direction for loosely receiving the second circuit end together with the second plate end when the first and the second connector members are fitted in the first direction to be coupled to each other; contact means of a plurality of second contact elements held in the second insulator and exposed in the groove means to be brought into contact with the conductor lines at the second circuit end received in the groove means, respectively; and urging means provided to the second insulator for engaging with the elastic plate means to urge the elastic plate means to force the conductor lines at the second circuit end onto the second contacts elements when the first and the second connector members are fitted in the first direction to be coupled to each other.

DESCRIPTION OF THE PREFERRED EMBODIMENT

Figure 1:
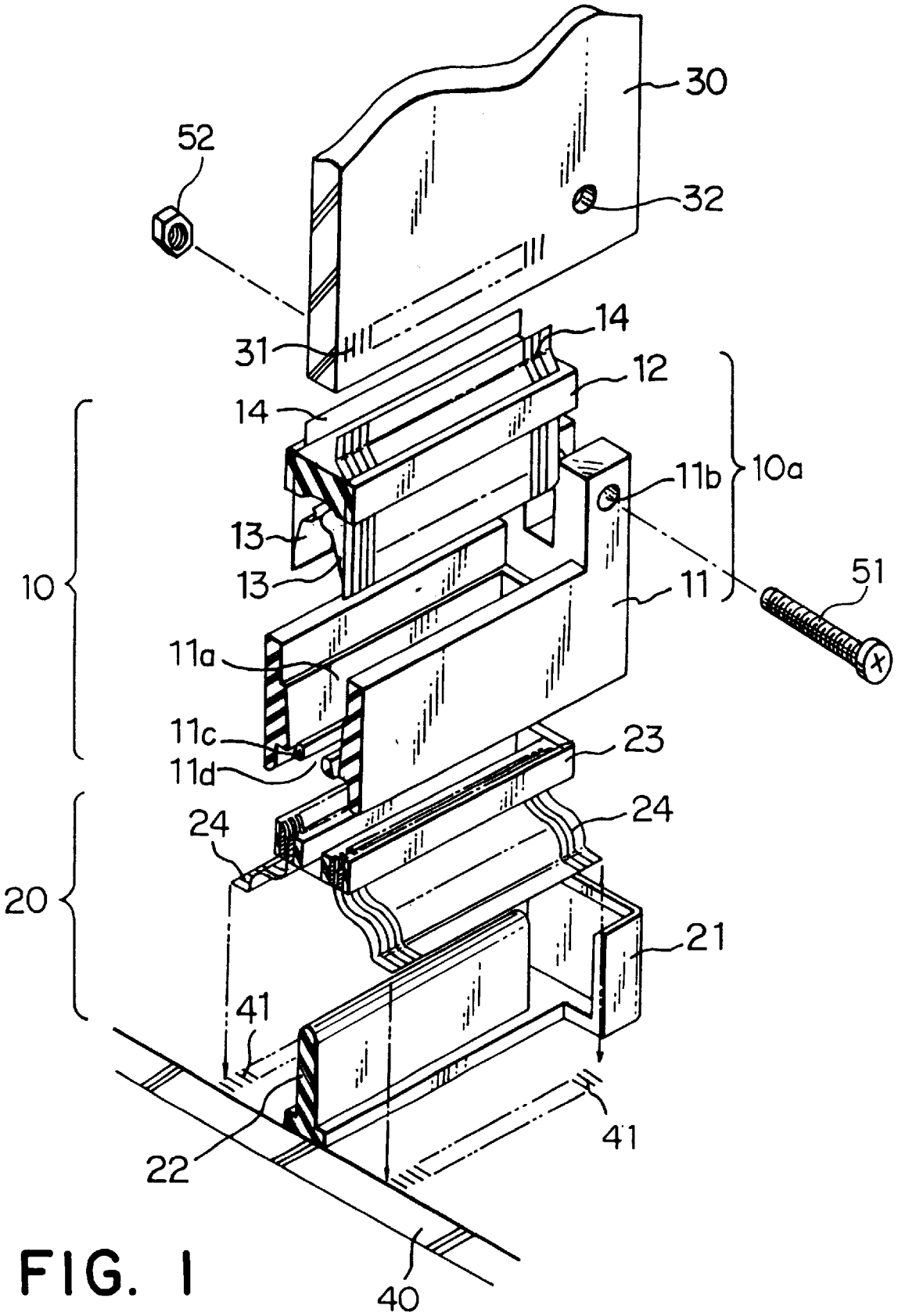
FIG. 1 is a partially sectioned perspective view of an electrical connector according to an embodiment of this invention in a disassembled condition.
Figure 2:
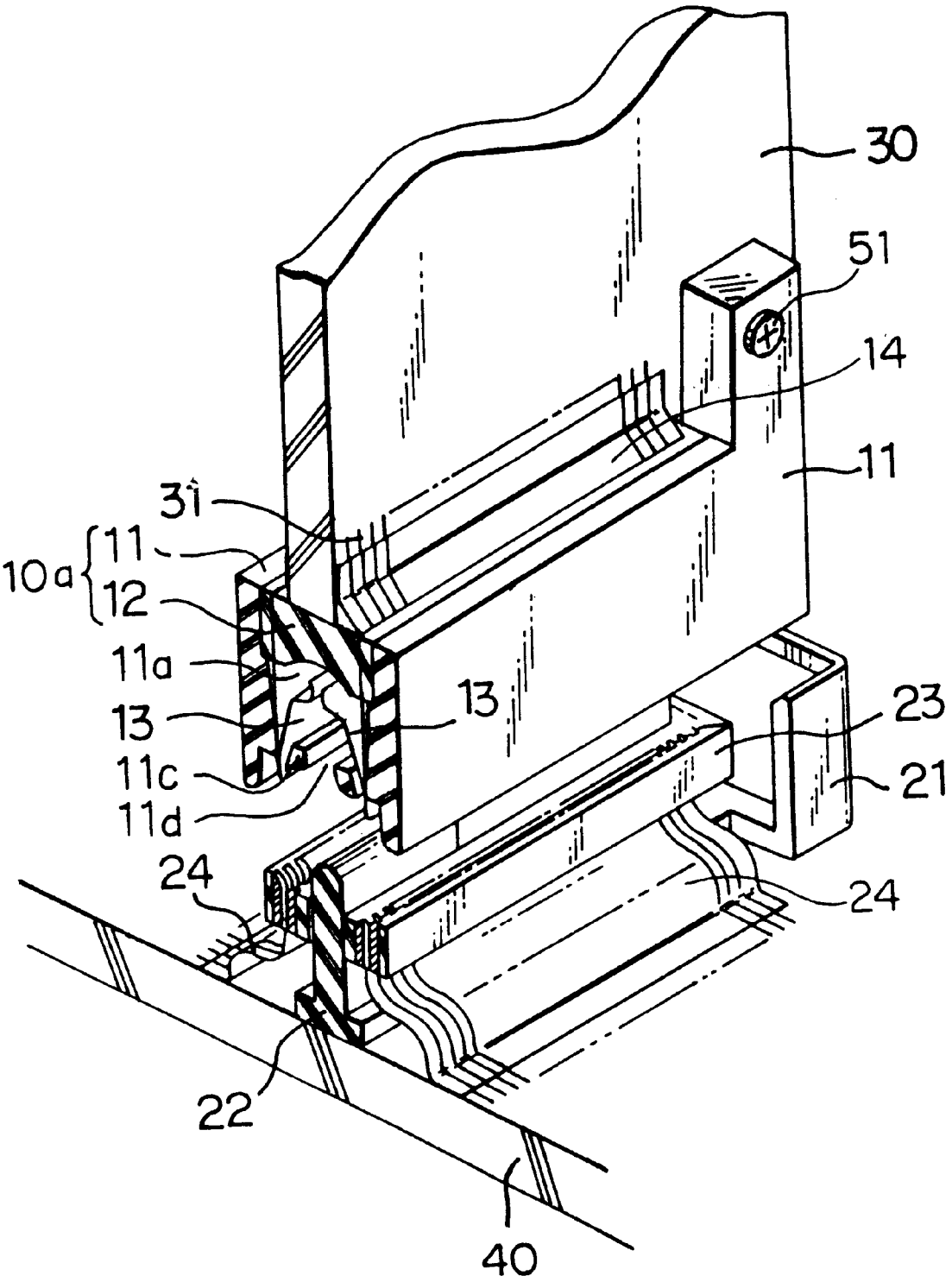
FIG. 2 is a partially sectioned perspective view of the connector of FIG. 1, in a condition before a first and a second connector member are fitted to each other.
Figure 3:
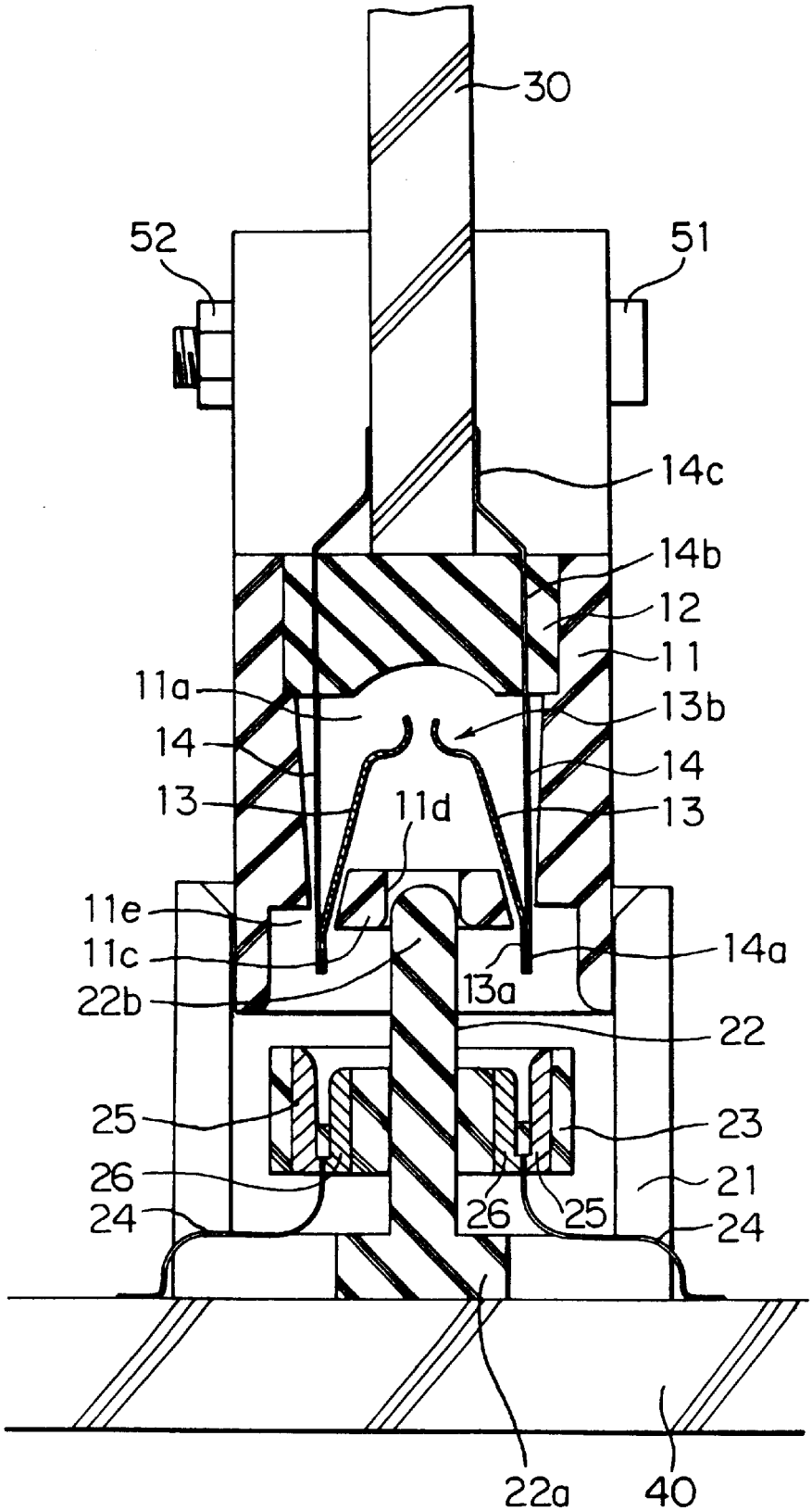
FIG. 3 is a sectional view of the connector of FIGS. 1 and 2, in a condition on a way that both connector members are being fitted to each other to establish electrical connection therebetween.

Referring FIGS. 1 to 3, an electrical connector according to an embodiment of this invention is used for in electrical connection and electrical disconnection between a card type-electric device 30 as a first electric device and a PCB 40 as a second electric device. The card type-electric device 30 and the PCB 40 have a plurality of electrical connection pads 31 and 41, respectively. In addition, the card type-electric device 30 has bolt passing holes one of which is shown at 32.

The connector comprises first and second connector members 10 and 20 mechanically mounted on and electrically connected to the card type-electric device 30 and the PCB 40, respectively. The first and second connector members 10 and 20 are fitted in a first direction (up-and-down direction in FIGS. 1 to 3) to be coupled with each other for the electrical connection and decoupled from each other for the electrical disconnection.

The first connector member 10 comprises a first insulator 10*a* to be mounted to the card type-electric device 30. The first insulator 10*a* comprises a housing portion 11 having an open top end and a contact holding portion 12 fixedly mounted on the housing portion 11 to close its open top end, so that a hollow space 11*b* is defined in the first insulator 10*a*. The contact holding portion 12 holds a pair of first flexible printed circuit (FPC) boards 14 as a pair of contact rows and is mounted onto the the card type-electric device 30. The housing portion 11 has bolt passing portions one of which is shown at lib. A plurality of bolts, one of which is shown at 51, are passed through corresponding ones of the bolt passing holes lib and 32 of the housing portion 11 and the card type-electric device 30, and nuts, one of which is shown at 52, are threaded onto ends of the bolts 51. Thus, the first connector member 10 is mechanically mounted on the card type-electric device 30. The housing portion 11 has a bottom plate portion 11*c* with a bottom surface or a first outer surface directed in the first direction. The bottom plate portion 11*c* has a guide hole 11*d* and a pair of contact holes 11*e* through which the pair of FPCs 14 led out from the first insulator la downwardly, respectively.

Each of the first FPC boards 14 comprises a first flexible insulator film and a conductor pattern of a plurality of conductor lines printed on one surface of the first flexible insulator film.

Each of the first FPC boards 14 has opposite first and second circuit ends 14*c* and 14*a* and a printed conductor pattern of a plurality of conductor lines extending in parallel with one another from the first circuit end 14*c* to the second circuit end 14*a*. Each of the first FPC boards 14 further has an intermediate portion 14*b* between the first and the second circuit ends 14*c* and 14*a*. Each of the first FPC boards 14 is held in the contact holding portion. 12 with the intermediate portion 14*b*. When the intermediate portion 14*b* is held in the contact holding portion 12, the first circuit end 14*c* is led out from the contact holding portion 12 to be electrically connected to the card type-electric device 30, while the second circuit end 14*a* is led out from the first outer surface The first connector member 10 further comprises a pair of elastic plates 13 Each of the elastic plates 13 has opposite first and second plate ends 13*b* and 13*a*. The second plate end 13*a* is fixed to the second circuit end 14*a*. Each of the elastic plates 13 is bent at a portion adjacent the second plate end 13*a* and extends in the hollow space 11*a*. The first plate end 13*b* is located above the guide hole 11*d*. The second connector member 20 comprises a second insulator 20*a* to be mounted on the PCB 40 The second insulator 20*a* comprises a base portion 22*a* to be mounted on the PCB 40, a projection 22 upwardly projecting from the base portion 22*a*, a guide portion 21, and a contact holding portion 23 mounted on said projection 22. The contact holding portion 23 is formed with a pair of grooves, each opening in the first direction for loosely receiving the second circuit end 14*a* together with the second plate end 13*a* when the first and the second connector members 10 and 20 are fitted in the first direction to be coupled to each other. A pair of contact rows of a plurality of second contact elements 25 are held in the contact holding portion 23 to be exposed in the pair of grooves, respectively, to be brought into contact with the conductor lines at the second circuit ends 14*a* received in the grooves, respectively. The projection 22 serves as urging means for engaging with the elastic plates 13 to urge the elastic plates 13 to force the conductor lines at the second circuit end 14*a* onto the second contacts 25 when the first and the second connector members 10 and 20 are fitted in the first direction to be coupled to each other.

The projection 22 has a top end portion 22*b* having a round-shaped section. The top end portion 22*b* may have a wedge-shaped section and so on.

The second connector member 20 further comprises a pair of second FPC boards 24 serving as lead means connected to the contact rows 25 and led out from the second insulator 23 to be electrically connected to the PCB 40. Each of the second FPC boards 24 has a printed conductor pattern of a plurality of conductor lines extending in parallel with one another. The conductor lines are connected to the second contact elements 25, respectively. The projection 22 is inserted through the guide hole 11*d* into the hollow space 11*a* to engage with the first plate end 13*b* when the first and said second connector members 10 and 20 are fitted to each other.

The contact holding portion 23 is slidable on and along the projection 22 in the first direction and is elastically supported by elastic means in the first direction. The second FPC boards 24 serve as the elastic means.

The housing portion 11 and the guide portion 21 extend in the first direction cooperate to guide the relative movement of the first and the second connector members 10 and 20 to be fitted in the first direction to each other. More specifically, the housing portion 11 is inserted in the guide portion 21 and are slidable in and along the guide portion 21 in the first direction.

Each of the first FPC boards 14 has a first ground pattern (not shown) printed on the other surface of the first flexible insulator film. The first ground pattern is connected to ground portion (not shown) of the card type-electric device 30.

The second connector member 20 further comprises a pair of ground contact elements 26. Each of the ground contact row 26 is disposed opposite to the second contact elements 25 in each of the groove to be brought into contact with the first ground pattern at the second circuit end 14*a* received in the groove. The second FPC board 24 has a second ground pattern printed on the other surface of the second flexible insulator film and connected to the ground contact element 26.

Thus, the first and the second FPC boards 14 and 24 realize micro strip line-circuit in the electrical connector according to this invention. Therefore, the connector is excellent in high-frequency characteristic.

Here, the first FPC board 14 has a ground pad (not shown) and a plurality of via holes (not shown). The ground pad is formed on the other surface of the first flexible insulator film located at the first circuit end 14*c*. The via holes are exposed on the one surface of the first flexible insulator film located at the first circuit end 14*c* and penetrate the first FPC board 14 toward the one surface of the insulator film at the first circuit end 14*c*. Furthermore, the via holes electrically connect to the conductor lines on the one surface of the first flexible insulator film. Therefore, the card type-electric device 30 is connected to each of the conductor lines and the ground pattern. In addition, the elastic plates 13 consists of a metal with low electrical resistance.

The second FPC board 24 has a ground pad (not shown) and a plurality of via holes (not shown). The ground pad is exposed on the other surface of the second flexible insulator film located at the first circuit end. The via holes are exposed on the one surface of the second flexible insulator film located at the first circuit end and penetrate the second FPC board 24 toward the one surface of the insulator film at the first circuit end. Furthermore, the via holes electrically connect to the conductor lines on the one surface of the second flexible insulator film. Therefore, the PCB 40 are connected to each of the conductor lines and the ground pattern.

Thus, the card type-electric device 30 and the PCB 40 are connected to each other through the micro strip line circuit in the connector.

In this embodiment, it is desirable that the connector comprises a locking structure for maintaining the condition that the first and the second connecter members 10 and 20 are mechanically connected to each other while resisting elasticity of the second FPC boards 24. In addition, if the supporting force by the second FPC boards 24 is insufficient, it is desirable that the connector comprises another elastic means such as a spring member.

Now, description will be made about operation of the electrical connector referring FIGS. 2 to 4.

In FIG. 3, the top end portion 22*b* of the projection 22 is partially inserted in the guide hole lid. The first plate ends 13*b* protrude away from the first FPC boards 14, respectively. The contact holding portion 23 is pushed up in the first direction by the second FPC boards 24.

When the first connector member 10 is moved down from a condition of FIG. 3, the second ends 14*a* of the FPC boards 14 are inserted and loosely received in the grooves of the contact holding portion 23 of the second connector member 20. The first outer surface of the first insulator 10*a* is brought into contact with the contact holding portion 23. Therefore, the first FPC board 14 is not applied the insertion force.

Thereafter, when the first connector member 10 is further pushed down together with the contact holding portion 23, the projection 22 passes through the guide hole 11*a* and goes into the hollow space 11*a*. Then, the projection 22 engages with the first plate ends 13*b* of the elastic plates 13 and pushes the first plate ends 13*b* in such a direction that the first plate ends 13*b* closes to the first FPC boards 14, respectively, as shown in FIG. 4A pushing force of the projection 22 is indicated by an arrow with a sign W. Thus, the first FPC boards 14 obtain a contact pressure against the contacts 25. As a result, the card type-electric device 30 and the PCB 40 are electrically connected to each other by the connector.

Figure 4:
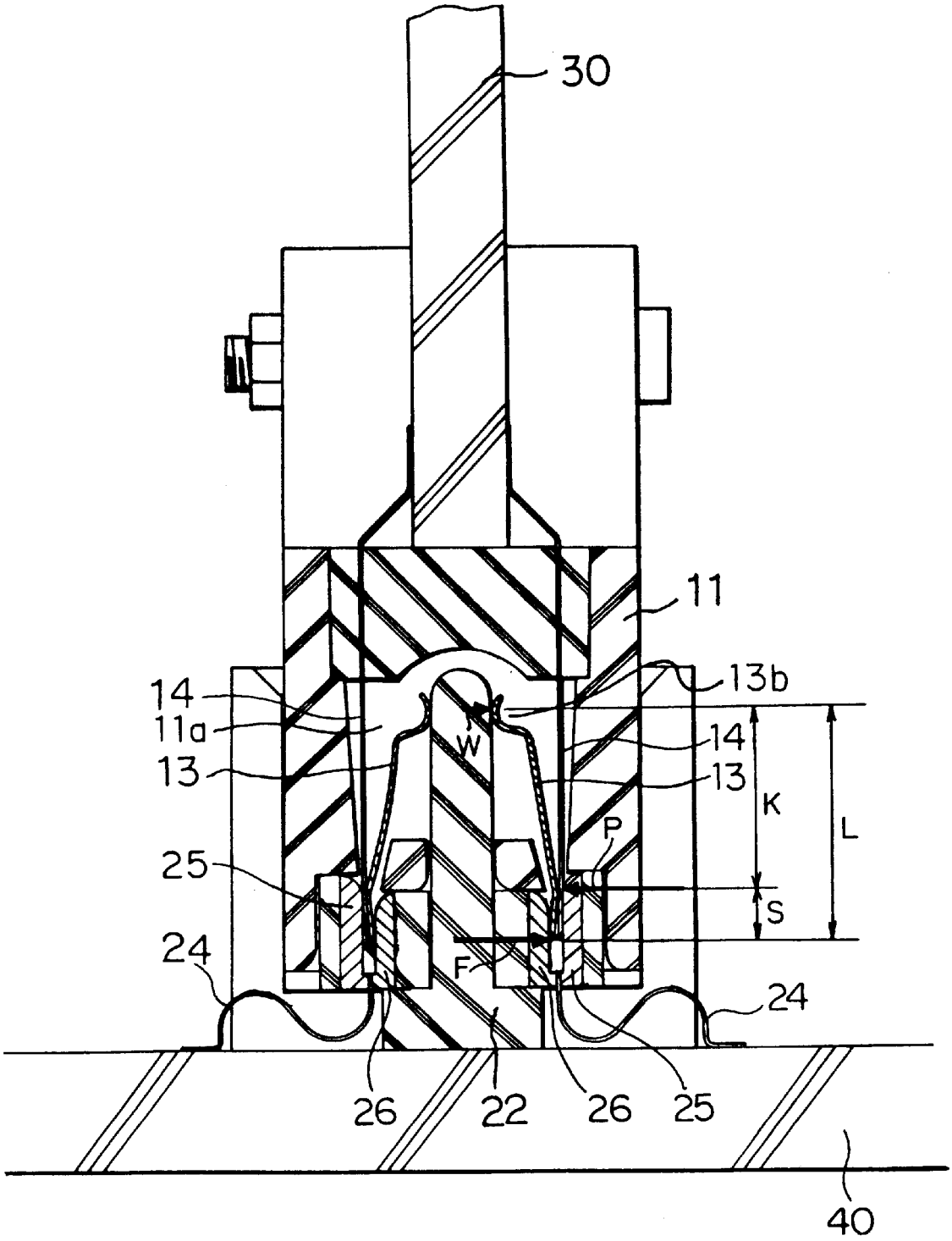
FIG. 4 is a sectional view of the connector in a condition after completion of the electrical connection.

Now, assume that the various dimensions of the elastic plate 13 are given by L, K, and S as shown in FIG. 4. A description will be made as to a relation between the contact pressure P and the pushing force W. The elastic plate 13 receives a reaction force P of the contact pressure at the bent portion. Further, the second plate end 13*a* is pressed onto the ground contact 26 with a contact pressure F by action of the pushing force. Thus, the elastic plate 13 receives a reaction force F of the contact pressure. Therefore, the relations of those forces acting on the elastic plate 13 are given by the following equations: $W=P\times(S/L)$ and $W=F\times(S/K)$, ignoring a flexural rigidity of the elastic plate 13. It is understood from those equations that pressure P and force F can be increased, even if W is small, by the design and ratios of the lengths K.L, and S. This means that a large contact pressure can be obtained while reducing the pushing force.

What is claimed is:

1. An electrical connector for use in electrical connection and electrical disconnection between first and second electrical devices, said connector comprising first and second connector members to be mechanically mounted on and electrically connected to said first and second electrical devices, respectively, said first and second connector members being fitted in a first direction to be coupled with each other for the electrical connection and decoupled from each other for the electrical disconnection, wherein said first connector member comprises:

a first insulator to be mounted to said first electrical device and having a first outer surface directed in said first direction;

first flexible printed circuit means having opposite first and second circuit ends and having a printed conductor pattern of a plurality of conductor lines extending in parallel with one another from said first circuit end to said second circuit end and serving as first contact elements, said first flexible printed circuit means being held in said first insulator with said first circuit end being led out from said first insulator to be connected to said first electrical device while said second circuit end being led out from said first outer surface; and elastic plate means having opposite first and second plate ends, said second plate end being fixed to said second circuit end, and wherein said second connector member comprises:

a second insulator to be mounted on said second electrical device and having groove means formed therein to open in said first direction for loosely receiving said second circuit end together with said second plate end when said first and said second connector members are fitted in said first direction to be coupled to each other;

contact means of a plurality of second contact elements held in said second insulator and exposed in said groove means to be brought into contact with said conductor lines at said second circuit end received in said groove means, respectively; and urging means provided to said second insulator for engaging with said elastic plate means to urge said elastic plate means to force said conductor lines at said second circuit end onto said second contacts elements when said first and said second connector members are fitted in said first direction to be coupled to each other.

2. An electrical connector as claimed in claim 1, which further comprises lead means connected to said contact means and led out from said second insulator to be electrically connected to said second electrical device.

3. An electrical connector as claimed in claim 2, wherein said first insulator has a hollow space formed therein, and a guide hole extending from said hollow space in said first direction to open in said first outer surface, said elastic plate means extending in said hollow space so that said first plate end is disposed to be aligned with said guide hole in said first direction, and wherein said urging means is a projection projecting from said second insulator in said first direction, said projection is inserted through said guide hole into said hollow space to engage with said first plate end when said first and said second connector members are fitted to each other.

4. An electrical connector as claimed in claim 3, wherein said second insulator is provided with a contact holding portion formed with said groove means, said contact holding portion being mounted on said projection and being slidable on and along said projection in said first direction, said contact holding portion being elastically supported by support means in said first direction.

5. An electrical connector as claimed in claim 4, wherein said lead means is a second flexible printed circuit means having a printed conductor pattern of a plurality of conductor lines extending in parallel with one another, said conductor lines being connected to said second contact elements, respectively, said second flexible printed circuit means serving as said support means.

6. An electrical connector as claimed in claim 5, wherein said first insulator has first guide means extending in said first direction and said second insulator has second guide means extending in said first direction, said first guide means and said second guide means cooperate to guide the relative movement of said first and said second connector members to be fitted in said first direction to each other.

7. An electrical connector an claimed in claim 5, wherein said first flexible printed circuit means comprises a first flexible printed circuit board comprising a first flexible insulator film and a conductor pattern of a plurality of conductor lines printed on one surface of said first flexible insulator film, and wherein said second flexible printed circuit means comprises a second flexible printed circuit board comprising a second flexible insulator film and a conductor pattern of a plurality of conductor lines printed on one surface of said second flexible insulator film.

8. An electrical connector as claimed in claim 7, wherein said first flexible printed circuit board has a first ground pattern printed on the other surface of said first flexible insulator film, said first ground pattern being connected to a ground portion of said first electrical device, and wherein said contact means further comprises a ground contact element held in said second insulator and opposite to said second contact elements to be brought into contact with said first ground pattern, said second flexible printed circuit board has a second ground pattern printed on the other surface of said second flexible insulator film and connected to said ground contact element.

9. An electrical connector as claimed in claim 1, wherein said first flexible printed circuit means comprises a first pair of flexible printed circuit boards each comprising a first flexible insulator film and a conductor pattern of a plurality of conductor lines printed on one surface of said first flexible insulator film, said pair of printed flexible circuit boards being held by said first insulator to be arranged in parallel with each other, and wherein said elastic plate means, said groove means, said contact means, and a second flexible printed circuit means comprise a pair of elastic plates, a pair of grooves, a pair of contact rows, and a second pair of flexible printed circuit boards, respectively, which are arranged to be corresponding to said pair of first flexible printed circuit boards.

* * * * *

UNITED STATES PATENT AND TRADEMARK OFFICE

CERTIFICATE OF CORRECTION

PATENT NO. : 5,975,934
DATED : November 2, 1999
INVENTOR(S) : Yoshiaki Ichimura

It is certified that error appears in the above-indentified patent and that said Letters Patent is hereby corrected as shown below:

Column 1, Line 22, insert --.-- after "elements";

Column 1, Line 35, delete "the" after "in";

Column 1, Line 35, delete "of" after "despite";

Column 1, Line 47, delete "the" after "in";

Column 1, Line 47, delete "of" after "despite";

Column 1, Line 50, delete "the" before "cost";

Column 3, Line 9, delete "lib" and insert --11b--;

Column 3, Line 11, delete delete "lib" and insert --11b--;

Column 3, Line 20, delete "la" and insert --lay--;

Column 3, Line 32, delete "." after "portion";

Column 3, Line 37, insert --.-- after "surface";

Column 3, Line 39, insert --.-- after the first "13";

Column 3, Line 46, insert --.-- after "40";

UNITED STATES PATENT AND TRADEMARK OFFICE

CERTIFICATE OF CORRECTION

PATENT NO. : 5,975,934
DATED : November 2, 1999
INVENTOR(S) : Yoshiaki Ichimura

It is certified that error appears in the above-identified patent and that said Letters Patent is hereby corrected as shown below:

Column 5, Line 13, delete "2" and insert --3--

Signed and Sealed this

Twenty-first Day of November, 2000

*Attest:*

Q. TODD DICKINSON

*Attesting Officer*

*Director of Patents and Trademarks*